United States Patent [19]

Satoh

[11] 4,065,806

[45] Dec. 27, 1977

[54] SEARCHLIGHT OR THE LIKE

[75] Inventor: Taiji Satoh, Koshigaya, Japan

[73] Assignee: Sanshin Dengu Manufacturing Co., Ltd., Japan

[21] Appl. No.: 718,221

[22] Filed: Aug. 27, 1976

Related U.S. Application Data

[63] Continuation of Ser. No. 534,183, Dec. 19, 1974, abandoned.

[30] Foreign Application Priority Data

June 28, 1974 Japan ..... 49-73264

[51] Int. Cl.[2] ..... F21M 3/18; F21S 1/02

[52] U.S. Cl. ..... 362/419; 362/420

[58] Field of Search ..... 240/48, 49, 61, 61.05, 240/61.11, 61.2, 61.3, 61.6, 61.7, 61.8

[56] References Cited

U.S. PATENT DOCUMENTS

| | | | |
|---|---|---|---|
| 1,686,452 | 10/1928 | Hoefler | 240/61.11 |
| 2,487,591 | 11/1949 | Ricci | 240/61 |
| 3,209,136 | 9/1965 | Fisher | 240/61.3 |
| 3,644,728 | 2/1972 | Hessemer et al. | 240/61.9 |

FOREIGN PATENT DOCUMENTS

| | | | |
|---|---|---|---|
| 609,932 | 10/1948 | United Kingdom | 240/61.11 |

*Primary Examiner*—R. N. Envall, Jr.
*Attorney, Agent, or Firm*—Kane, Dalsimer, Kane, Sullivan and Kurucz

[57] ABSTRACT

A searchlight or the like comprising a base, a housing rotatable horizontally and accommodating one or more lamps and reflectors, and a planetary rotation mechanism provided between the base and the housing to rotate the housing. A support frame carrying lamps and reflectors thereon is pivotally connected within the housing for vertical tilting movement centering around a horizontal axis passing through focal points of the reflector. The irradiation angle can be easily varied by tilting upwardly or downwardly the supporting frame without tilting the heavy housing. The circumferential position of irradiation can be changed by operating the planetary rotation mechanism which is compact in size.

2 Claims, 7 Drawing Figures

SEARCHLIGHT OR THE LIKE

This is a continuation of application Ser. No. 534,183 filed on Dec. 19, 1974 now abandoned.

BACKGROUND OF THE INVENTION

This invention relates to a searchlight or the like.

In general, a searchlight which is small in size, light in weight and provides superior performance, has been requested to reduce space to use and weight. This is particularly true for use in vehicles. In a conventional searchlight, a housing accommodating a lamp and reflector therein was pivotally connected to long supporting arms upstanding on both sides of a base, and hence the heavy housing had to be pivotally moved for adjustment of the vertical irradiation angle. Therefore, such a conventional searchlight required relatively large power, that is, large motor and also required much space for tilting vertically freely the entire housing without touching the base. As a result, the conventional apparatus per se was large in size, heavy in weight and extremely high in height.

BRIEF SUMMARY OF THE INVENTION

Accordingly, it is a object of this invention to provide a searchlight which is small in size, light in weight and has superior performance.

It is another object of this invention to provide a searchlight which permits easy adjustment of irradiation angle without tilting the entire housing.

It is another object of this invention to provide a searchlight having a simple and compact mechanism for rotating horizontally the housing accommodating lamps and reflectors.

It is a further object of this invention to provide a searchlight which enables an electrical connection between a base and a horizontally rotatable housing without exposing lead wires for lamps and motors outside the housing.

According to one aspect of the invention, there is provided a searchlight comprising a base, a hollow housing mounted on the base for horizontal rotation and opened at the front end, a means for supporting at least one lamp and reflector at the front within the housing, said means being pivotally connected for upward and downward tilting movement centering around a horizontal axis passing through a focal point of the reflector, and a means for tilting upwardly and downwardly the supporting means arranged within the housing.

In further accordance with the invention, the searchlight further comprises a planetary rotation means for rotating horizontally said housing and provided between the housing and the base, said means including a drive sun wheel, a stationary planet ring fixedly secured to the base concentrically with the drive sun wheel, and at least one planetary wheel which is rotatably mounted on a stationary shaft secured to the housing and which is arranged between the sun wheel and the stationary planet ring in pressuring engagement therewith.

The above and other objects and features of the invention will become more apparent from the following description taken in connection with the accompanying drawings wherein.

DETAILED DESCRIPTION

Figure 1:
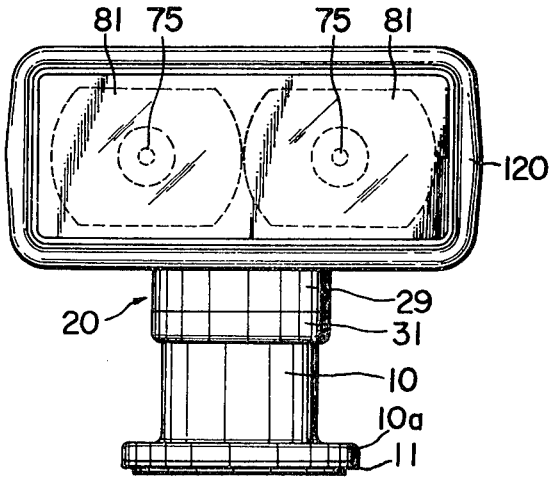
FIG. 1 is a front view of an external appearance of a searchlight according to the invention.
Figure 2:
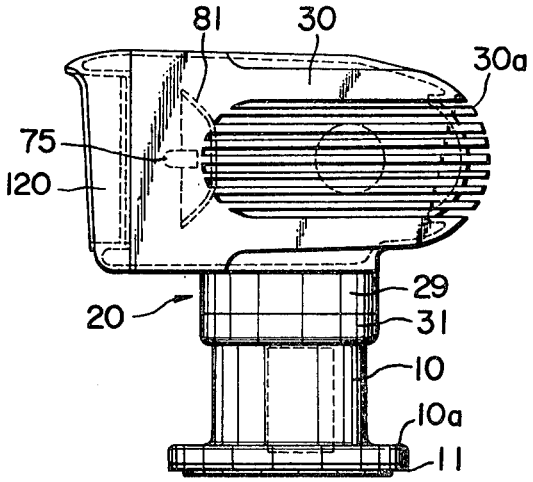
FIG. 2 is a side view of an external appearance of the searchlight shown in FIG. 1.

Referring to FIGS. 1 and 2 showing external appearance views of a searchlight according to the invention, the searchlight generally comprises a cylindrical base 10 having a gasket 11 for water proof and a flange **10*a*, a housing 30 accommodating lamps 82 and reflectors 86, a front frame 120 with a front glass mounted on the front of the housing 30, and a means 20 for horizontally rotating the housing 30 and arranged between the housing 30 and the base 10**.

Figure 3:
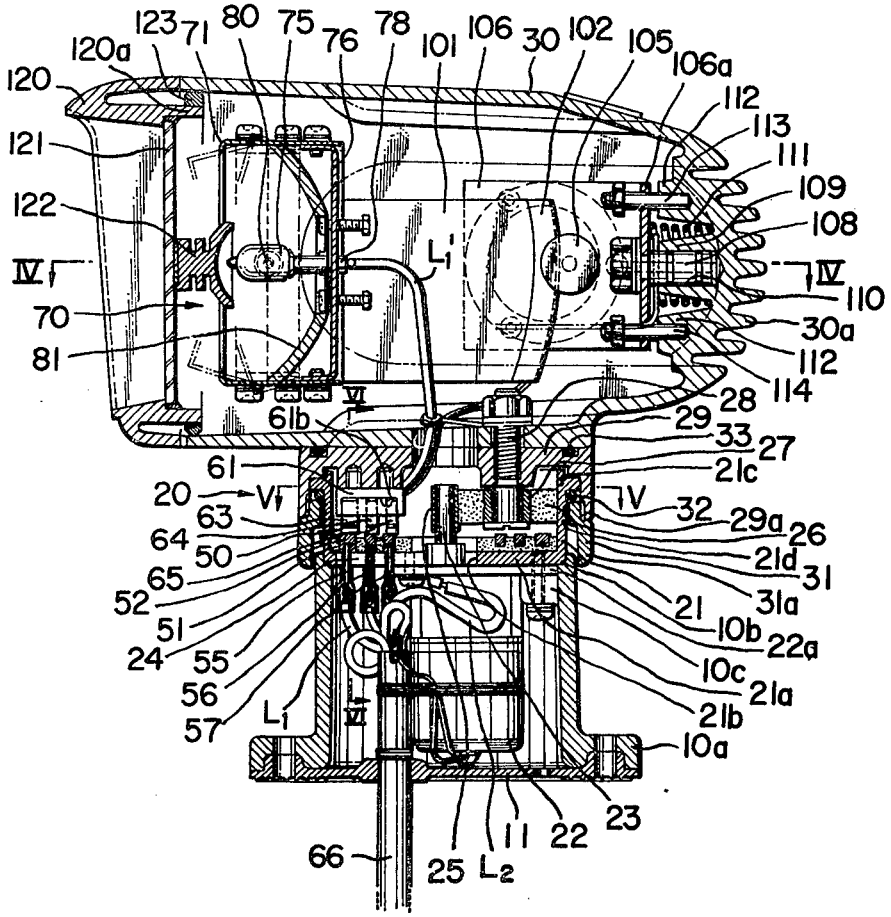
FIG. 3 is a sectional view of the searchlight according to the invention suitably taken along the line III — III of FIG. 4.

Referring now particularly to FIG. 3, the housing rotating means 20 utilizing a planetary rotation mechanism will be explained below. A stationary planet ring 21 is fitted in a peripheral inner stepped portion **10*b* on an upper end of the base 10 and a geared motor 22 for the housing rotating means 20 is attached to a lower surface of a bottom plate 21*a* by means of bolts. The connection between the stationary planet ring 21 and the base 10 is effected by interposing the flange 22*a* of the geared motor 22 between a ball seat 10*c* projecting inwardly from the upper peripheral wall of the base 10 and the bottom plate 21a, and fastening them by bolts. A shaft 23 of the geared motor 22 projects from a central opening 21*b* on the bottom plate 21*a* of the stationary planet ring 21. In communication with the central opening 21*b*, a notch 24** extends radially to provide a space for passing connecting pins therethrough, as will be explained later.

A sun wheel 25 is firmly mounted on the shaft 23 of the geared motor 22 and the axis thereof is concentric with the stationary planet ring 21.

Figure 5:
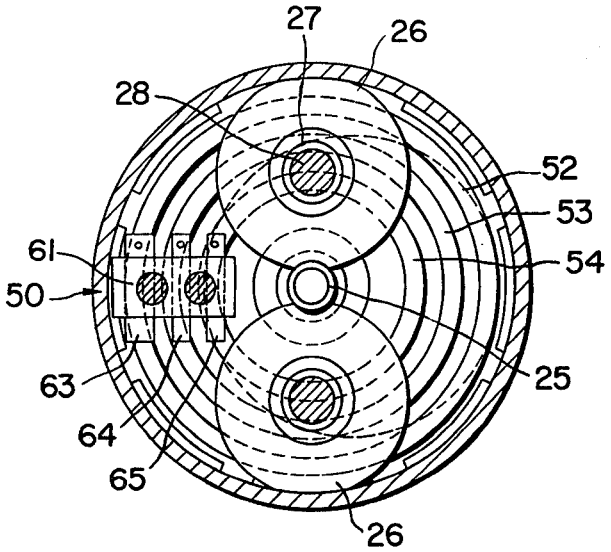
FIG. 5 is a view, taken along the line V — V of FIG. 3, showing an arrangement of a current collector with slip rings and planetary wheels within a stationary planet ring.

As is best seen from FIG. 5, two planetary wheels 26 of resilient material are arranged symmetrically between the sun wheel 25 and the stationary planet ring 21. These planetary wheels 26 which are fixedly secured to an inner collar 27, are mounted for rotation about a stationary shaft 28, and the size of the planetary wheels 26 is dimensioned so that they engage with the outer peripheral surface of the sun wheel 26 and the inner peripheral surface of the stationary planet ring 21 under sufficient pressure. A planetary carrier 29, in which the planetary wheel shaft 28 is inserted, is placed for circumferential sliding movement on an annular protrusion extending outwardly from the upper end wall of the stationary planet ring 21. The planetary carrier 29 and the housing 30 thereon are fixed together by fastening a threaded portion of the planetary wheel shaft 28 passing therethrough by means of a nut. Accordingly, when the planetary wheels 26 have been rotated about the sun wheel 25 while rotating about the planetary wheel shaft 28, the housing 30 and the planetary carrier 29 rotate as one unit, sliding on the stationary planet ring 21 secured to the base 10.

The planetary carrier 29 is provided with a peripheral depending wall 29*a* in contact with the outer peripheral surface of the annular protrusion 21*c* of the stationary planet ring 21. The peripheral depending wall 29*a* is threaded at the lower end on the inner peripheral surface and a seal ring 31 is threadably connected to the threaded portion thereof. The upper inner peripheral surface of the seal ring 31 faces the outer peripheral surface of the stationary planet ring 21 having a V-shaped peripheral groove 21*d*, leaving a small gap therebetween, so that undesirable entrance of any dust and water from the outside may be prevented. Similarly, a peripheral depending wall 31*a* of the seal ring 31 is formed so as to overlap the outer peripheral surface at the upper end of the base 10 leaving a small gap therebetween. Further, in order to prevent undesirable entrance of water, 0-rings 32 and 33 are provided between the annular projection 21*c* and the upper end surface of the seal ring 31, and between the planetary carrier 29 and the housing 30, respectively.

Figure 6:
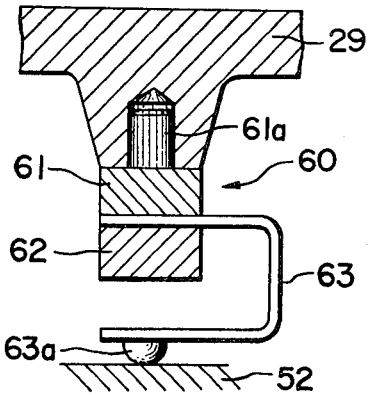
FIG. 6 is a fragmentary detailed sectional view of a brush assembly taken along the line VI — VI of FIG. 3.

As is best seen from FIG. 5, a current collector 50 including slip rings and a brush assembly is arranged between two planetary wheels 26 of the housing rotating means 20. Referring to FIG. 3, an annular insulating plate 51 is mounted on the bottom plate 21*a* of the stationary planet ring 21 and three slip rings 52, 53 and 54 are embeded in the insulating plate 51. Connecting pins 55, 56 and 57 each coated with insulating cover extend downwardly from the respective slip rings and are connected on a way with lead wires from a controlling board (not shown). On the other hand, as is best seen from FIG. 3 and FIG. 6, the brush assembly 60 rotating on the slip rings in sliding engagement therewith consists of a brush holder 61 having a pole-like projection 61*a* extending upwardly and a groove 61*b* opening downwardly, and a [-shaped leaf springs 63, 64, 65 glued to the groove 61*b* of the holder 61 through an insulating material 62. The leaf spring 63 is dimensioned such that a contact 63a thereon is normally brought into intimate contact with the slip ring 52 by a resilient force of the leaf spring 63. The brush holder 61 is fixedly secured by fitting and gluing its pole-like projection 61*a* into a corresponding hole of the planetary carrier 29.

Another important feature of this invention resides in the provision of a means for tilting a supporting means for lamps and reflectors to vary the vertical irradiation angle and which is accommodated within the housing 30. This tilting means 100 will be explained below. In this embodiment, the supporting means for lamps and reflectors includes a supporting frame 70 and pivots 82. The supporting frame 70 consists of a [-shaped reflector supporting plate 71, [-shaped side plates 73, 74 carrying the upper and lower plates of the reflector supporting plate 71 at both ends in vertically spaced relation, [-shaped sockets 76 for lamps fixedly secured within the reflector supporting plate 71 at the back of the lamps 75, and a vertical intermediate stay 77 supporting the upper and lower plates of the reflector supporting plate 71 in the middle.

The lamps 75 are each mounted on the supporting frame by fastening a lamp cap 78 to the socket 76 by means of bolts. 80 indicates a filament in the lamp 75 positioned at the focal point. The reflectors 81 each positioned at the back of the lamp 75 are defining a parabolic surface are fixedly mounted on the reflector supporting plate 71 at the upper and lower end surfaces. Although in this embodiment two lamps 75 are arranged in juxtaposed relationship, of course any number of lamps may be provided. With such construction, the supporting frame 70 for lamps and reflectors is supported by pivots 82 on both side walls of the housing 30 for rotation about the longitudinal horizontal axis of the supporting frame passing through the focal points of the reflectors. Therefore, the entire supporting frame may be pivotally moved about the pivots 82 within the housing 30 by a supporting frame tilting means 100 to change the vertical irradiation angle.

In this embodiment, the lamps and reflectors are mounted on the supporting frame and the same is supported within the housing for vertical pivotal movement. However, of course it is possible to attach pivots directly to the reflector per se and support the same on the housing for vertical pivotal movement.

Figure 4:
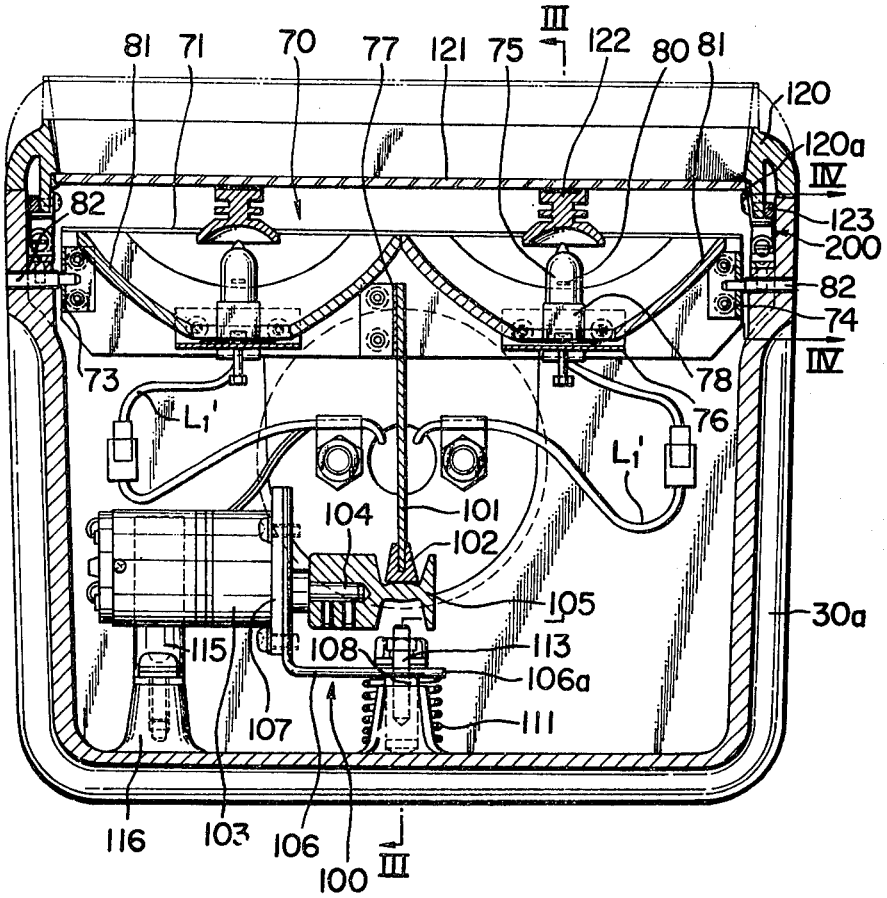
FIG. 4 is a sectional view of the searchlight taken along the line IV — IV of FIG. 3.
Figure 7:
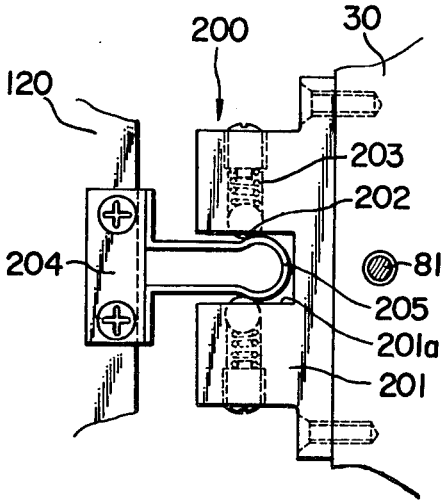
FIG. 7 is a view, taken along the line VII — VII of FIG. 4, showing an elastic latching means between a housing and a front frame.

The supporting frame tilting means 100 is arranged at the back of the supporting frame 70 within the housing 30. A movable elevation plate 101 is fixedly secured to a vertical entermediate stay 77 of the supporting frame 70 and an elongated elastic body 102 is glued to the movable elevation plate 101 along an outer peripheral edge thereof and defines an outer peripheral surface with the focal point as a center. Further, in rotating engagement with the outer peripheral edge of the elastic body 102 on the movable elevation plate 101 is a pulley 105 having a trapezoid groove fixedly mounted on a shaft 104 of a geared motor 103. The geared motor 103 is horizontally mounted at its flange 107 on a L-shaped motor supporting plate 106. As is best seen from FIG. 3, it is mainly supported by a movable guide bar 108 which is fixedly secured to the bottom plate 106*a* and slidably fitted in a guide hole 110 of a loss 109 projecting inwardly from the housing 30. A coil spring 111 is disposed about the loss 109 on the housing 30 guiding the movable guide bar 108 so that the motor supporting plate and hence the pulley 105 may be normally pressed against the elastic body 102 of the movable elevation plate 101. In this case, as shown in FIG. 3, auxiliary stationary guide bars 113 and 114 tightly fitted in the boss 112 on the housing 30 is positioned above and below the movable guide bar 108 to serve to guide properly and smoothly the motor supporting plate 106. Further, in order to prevent the supporting plate 106 and pulley 105 from being inclined due to the weight of the geared motor 103, a L-shaped motor guie plate 115 for supporting the under surface of the geared motor is firmly mounted on a boss 116 projecting from the housing 30 by means of screws. The front frame 120 is removably mounted on the front end of the housing 30, for example by means of an elastic latching device 200 on both sides of the housing 30, as shown in FIGS. 4 and 7. The front glass 121 is attached to the front frame 120 and sub mirrors 122 for prevention of dazzlement are glued to the inside surface of the front glass 121 just in the front of the lamps 75. A gasket 123 is provided between the inner peripheral surface of the wall of the housing 30 and an inner wall 120*a* out of double walls of the front frame 120 to prevent entrance of any dust and water.

Now, the above-mentioned elastic latching device 200 will be briefly explained with reference to FIG. 7. Balls 202 are normally pressed by means of springs 203 so as to partially project from both sides of a groove 201(a) in the center of a body 201 secured to the housing 30 with screws. On one hand, a resilient member 205 in the form of a circle at the end portion is attached through a base 204 to the end surface of the front frame 120 to be mounted. With such construction, mounting or dismounting of the front frame 120 may be performed merely by pushing into or pulling off the front end of the housing 30. However, of course any conventional means may be employed to mount the front frame of the housing.

Wiring for lamps 75 will be briefly explained. As shown in FIG. 3, one lead wire L, from a controlling board is connected to the slip ring 52 and in turn to the lamp 75 through the brush 63 and a lead wire $L_1'$, while the other lead wire $L_2$ is connected to the flange 22*a* of the motor 22, from where the body of the searchlight is utilized as a conductor in place of a lead wire for connection to the lamp 75. Two another smaller brushes 64 and 65 are connected to the motor 103 for the supporting frame tilting means 100. These lead wires are all collected in a guide tube 66 together with lead wires from the motor 22 for the housing rotating means and taken out from the lower portion of the base 10.

As seen in FIGS. 2 and 3, a great number of ribs are formed extending horizontally along the outer peripheral wall surface of the housing 30, so that the heat within the housing may be cooled by natural draft.

The operation of the searchlight so constructed will be explained below. In general, all the lights emitted from the filament of the lamp 75 will be reflected horizontally by the parabolic surface of the reflector 81. The supporting frame tilting means 100 is operated to adjust or change the vertical irradiation angle of the reflected lights. Upon starting the geared motor 103 to rotate the pulley 105, the movable elevation plate 101 in intimate contact with the pulley 105 is pivotally moved upwardly or downwardly according to the direction of revolution of the pulley 105, so that the supporting frame 70 directly connected with the movable elevation plate 101 is pivotally moved about the pivots 82 to thereby change the irradiation angle. In FIG. 3, the maximum upward and downward tilted positions are indicated by chain lines.

The horizontal irradiation position of the searchlight can be changed by operating the housing rotating means 20. Upon rotation of the sun wheel 25 fixedly mounted on the motor shaft 23 with energization of the geared motor 22, the planetary wheel 26 is rotated around the sun wheel 25 while revolving around the planetary wheel shaft 28, so that the housing 30 and planetary carrier 29, to which the shaft 28 is fixedly secured, are rotated together around the axis of the sun wheel 25, with the planetary carrier 29 sliding on the annular protrusion 21*c* of the stationary planet ring 21.

The searchlight according to the invention is so constructed that the reflector per se which is light in weight can be pivotally moved without tilting the entire housing heavy in weight as in the prior art to adjust the vertical irradiation angle. Therefore, it requires only less power and hence the tilting means for the reflector can be housed extremely compactly within the housing, with the result that the entire apparatus is lower in height. With the planetary rotation mechanism employed in the housing rotating means, the axis of the drive motor and the center of revolution of the housing agree with each other, and therefore the apparatus occupies less space and become compact in size. Thus, according to the invention, the searchlight reduced in size substantially half the conventional searchlight and also provides superior performance.

Further, since the current collector with slip rings are used for electrical connection between the motor and lamps within the rotating housing and the stationary base, lead wires are not exposed outside the apparatus and hence no danger due to the damage thereof will not occur, and in addition the apparatus looks fine externally.

While the described embodiment represents the preferred form of the present invention, it is to be understood that modifications will occur to those skilled in that art without departing from the spirit of the invention. The scope of the invention is therefore to be determined solely by the appended claims.

What is claimed is:

1. A searchlight comprising a base; a planetary rotation means mounted water-tightly on said base; and a housing mounted water-tightly on said planetary rotation means for horizontal rotation and having only at the front end an opening tightly closed by a front glass; said planetary rotation means including a motor accommodated within said base, a drive sun wheel firmly mounted on a shaft of said motor, a stationary planet ring fixedly secured to said base concentrically with said drive sun wheel, and at least one planetary wheel which is rotatably mounted on a stationary shaft secured to said housing and which is arranged between the drive sun wheel and the stationary planet ring in pressuring engagement therewith; said housing having therein a support frame of sheet metal pivotally supported on the inner wall thereof in a position adjacent the front glass for upward and downward tilting movement, said support frame carrying at least one lamp and reflector and having pivots lying on a horizontal axis passing through a focal point of said at least one reflector, and said housing also having therein a means for tilting said support frame upwardly and downwardly, said tilting means including a vertically pivotal elevation plate fixedly secured to the support frame and defining at its outer peripheral edge a circular arc centering around the pivots of said support frame, and a drive pulley firmly mounted on a shaft of a motor and adapted to be normally pressed against the outer peripheral edge of said elevation plate by means of spring force.

2. A searchlight as set forth in claim 1, a current collector is provided between said stationary planet ring and said rotatable housing, said current collector including a brush assembly secured to the housing and slip rings firmly mounted on said stationary planet ring.

* * * * *